United States Patent [19]

Hetherington

[11] Patent Number: 4,684,186

[45] Date of Patent: Aug. 4, 1987

[54] ELECTRICAL OUTLET ASSEMBLY

[76] Inventor: Michael W. Hetherington, R.R. No. 1, Cedar Valley, Ontario, Canada, L0G 1E0

[21] Appl. No.: 888,401

[22] Filed: Jul. 23, 1986

[51] Int. Cl.[4] ..... H01R 29/00

[52] U.S. Cl. ..... 439/171; 439/120; 439/651; 439/491

[58] Field of Search ..... 339/20–24, 339/31, 32, 154, 156, 18, 157 R, 157 C, 159 R, 159 C, 164 M, 166 R, 198 R, 113 R

[56] References Cited

U.S. PATENT DOCUMENTS

| | | | |
|---|---|---|---|
| 2,922,054 | 1/1960 | Miller | 339/32 M |
| 3,210,578 | 10/1965 | Sherer | 339/32 M |
| 3,581,480 | 6/1971 | O'Connor et al. | 339/32 M |
| 4,047,781 | 9/1977 | DeNigrist et al. | 339/32 R |
| 4,313,646 | 2/1982 | Millhimes et al. | 339/156 R |
| 4,386,333 | 5/1983 | Dillan | 339/31 M |
| 4,408,820 | 10/1983 | Eaby et al. | 339/156 R |
| 4,462,656 | 7/1984 | Beyer | 339/154 A |

OTHER PUBLICATIONS

Advertisement "Electri-Pak 7", date unknown.

*Primary Examiner*—Gil Weidenfeld
*Assistant Examiner*—David Pirlot
*Attorney, Agent, or Firm*—Ridout & Maybee

[57] ABSTRACT

A wiring system is provided for offices and similar environments, in which simplex outlet units may be plugged into outlet assemblies connected to several different supplies so as to provide combinations of outlets suited to the requirements of different work stations. The simplex outlet units are all identical, connections to different supplies being achieved by selecting the angular orientation of the units as they are plugged into the assembly. There are indicators to show which supply is being tapped by any outlet, and interlocks to prevent an outlet being removed for so long as equipment is plugged into it.

9 Claims, 7 Drawing Figures

ELECTRICAL OUTLET ASSEMBLY

FIELD OF THE INVENTION

This invention relates to a wiring system for offices and similar environments which provides outlets attached to different segregated power supplies, typically the two phases of a conventional three wire supply, together with a separate, shielded "clean" supply for data processing and other equipment sensitive to irregularity and interference on its power supply.

BACKGROUND OF THE INVENTION

Several generally similar but mutually incompatible systems are available on the market providing the above facilities. In such a system, typified by the ELECTRIPAK 7 system from Electri-Cable Assemblies Inc., each outlet unit consists of a series of plug together modules, including outlet modules which can be plugged into the assembly in any desired combination to meet local requirements. In practice, the system is less flexible than at first appears, since the ability to change the outlet combination available at any station depends on the availability of stocks of three different types of proprietary simplex outlet modules for interchange purposes. The modules need to be colour or otherwise coded to indicate which supply they are configured to tap.

SUMMARY OF THE INVENTION

An object of the present invention is to provide a system of the type discussed in which a single type of simplex outlet may be utilized, whilst maintaining identification of the supply being tapped by any individual simplex. A further object is to permit simplexes to be readily inserted and removed whilst preventing accidental dislodgement during normal operation.

According to the invention an outlet assembly, for providing at least one outlet selectively tapping different groups of conductors present in the assembly and representing different electrical supplies, comprises a body having at least one recess for receiving any of a plurality of similar outlet units in any of a plurality of different orientations to which it can be rotated about a central axis, the body incorporating a plurality of conductive buses passing beneath the recess and connected to the conductors of the supplies to be tapped, and defining a pattern of holes located in the bottom of the recess relative to the plurality of buses to enable the latter to be tapped by conductive pins inserted in the holes, each outlet unit having a number of conductive pins on its rear surface at least equal to the number of conductors in a supply to be tapped and connected to outlet sockets in the outlet unit, the pins and holes being arranged such that in different orientations in which the recess can receive the outlet unit, the pins of the latter will tap the conductors of different supplies, the outlet unit and the body further comprising cooperating means to indicate which supply has been tapped. Preferably the body defines several identical recesses arranged on one or opposite sides of the body, both the recesses and the outlet units preferably being square. Preferably the conductors represent three different supplies, the opposite phases of a conventional three wire supply, and a "clean" supply for equipment sensitive to supply line disturbances. Preferably the cooperating means to indicate which supply has been tapped comprises a boss on the body which appears in different windows defined in each outlet unit according to the orientation of the latter. Preferably also each outlet unit is a receptacle configured to receive a plug, and includes interlock means actuated by insertion of the plug to lock the outlet unit to the body for so long as the plug remains in the receptacle.

Further features of the invention will become apparent from the following description with reference to the accompanying drawings.

IN THE DRAWINGS

DESCRIPTION OF THE PREFERRED EMBODIMENT

Figure 1:
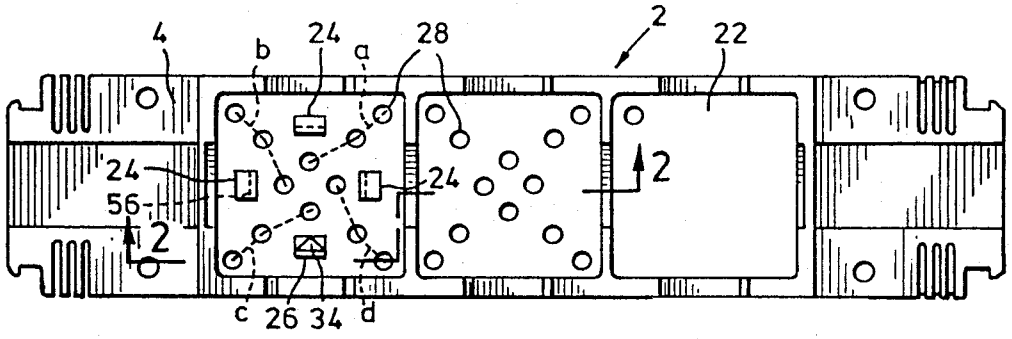
FIG. 1 is a view of one side of the body of a multiple outlet unit for use in the system of the invention, the opposite side being identical.
Figure 2:
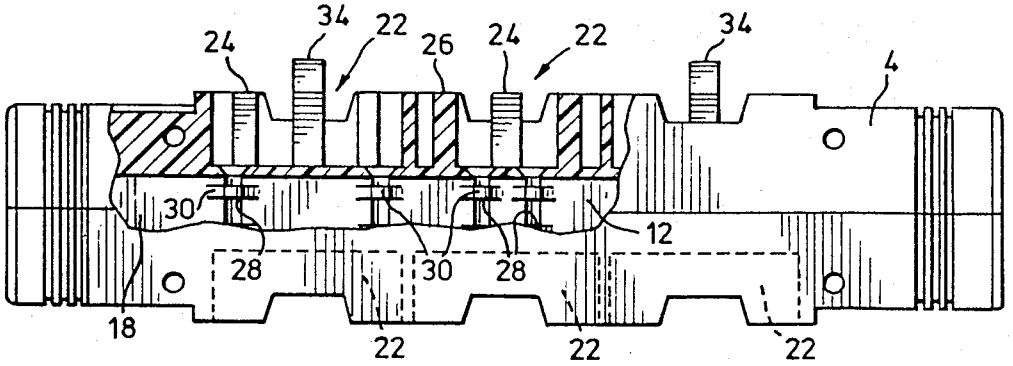
FIG. 2 is a top or bottom view of the unit of FIG. 1, partially broken away on the line 2—2 in FIG. 1 to show details of the internal structure.
Figure 7:
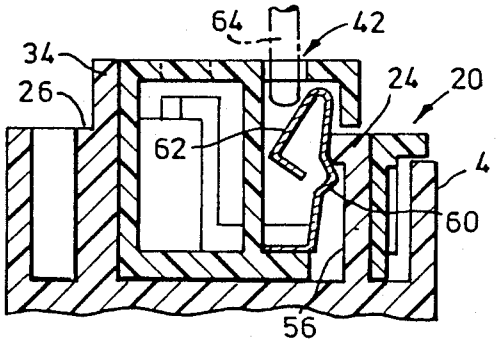
FIG. 7 is a section through a simplex outlet unit received in a recess.

FIGS. 1 and 2 show a body 2 which receives plug in simplex outlet units 20 (see FIGS. 3–6) to form an outlet unit. The body comprises two identical mouldings 4 secured back to back (so that the opposite side of the body has an appearance identical to that shown in FIG. 1), with a series of longitudinal bus bars 6, 8, 10, 12, 14, 16, 18 (see FIG. 3) located in slots in the mating faces of the mouldings. The ends of the body 2 form sockets through which connections are established with supply sources or adjacent units by means of suitable connectors, the details of which form no part of the invention and are not described.

Figure 3:
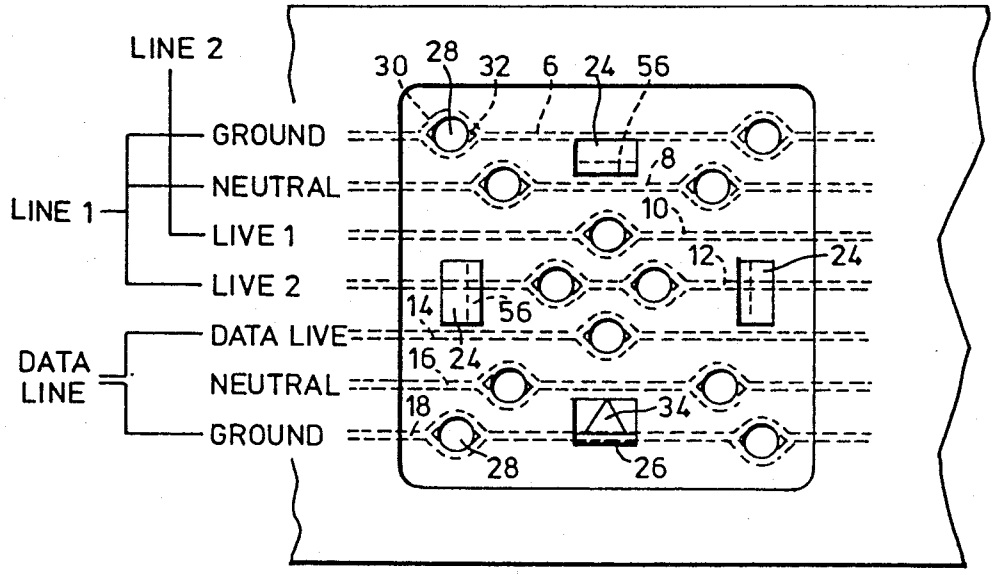
FIG. 3 is an enlarged view of one of the square recesses seen in FIG. 1.

The mouldings 4 are each formed with a plurality of square recesses 22, the bottom of the recesses each being formed with a symmetrical pattern of bosses 24 and 26 and holes 28. For simplicity, not all the bosses and holes are shown in each recess, the arrangement being in each case identical. Where a hole 28 intersects a bus bar, that bus is formed with slots forming straps 30, the straps being struck outwards in opposite directions so as to define bores 32 through the bus bars in alignment with the holes 28. The bosses are arranged spaced from the mid point of each wall of a recess, one boss 24 having an extension 34 projecting proud of the moulding whilst the other bosses 26 terminate flush with the outer surface. The extension 34 of the boss 24 has an arrowhead shape and is coloured, preferably red, on its end surface to contrast with the body colour of the outlet units 20. The holes 28 are twelve in number, arranged as best seen in FIG. 3 at the corners of three concentric squares and so as to coincide with the lines of the seven buses 6–18, either so that a single hole intersects the line of a bus half way across the recess, or so that two symmetrically spaced holes intersect the line of a bus. The holes of the two outer squares are arranged on the diagonals of the recess, whilst the innermost square is rotated through 45° relative to the other two. The outermost buses 6 and 18 are ground buses, accessible through the holes 28 in the outer square, the buses 8 and 16 are neutral buses accessible through the holes 28 of the middle square, and the buses 10, 12 and 14 are line buses, accessible through the holes 28 of the innermost square. The buses 14, 16 and 18 are the respective line, neutral and ground conductors of a "clean" supply for sensitive equipment, where buses 10 and 12 are the opposite phase conductors of a three wire supply, the bus 8 providing a common neutral conductor and the bus 6 a common ground conductor associated with these phase conductors. Obviously some rearrangement of the buses and holes 28 would be possible according to the number of supplies to be handled and the relative locations of the ground and neutral bus could be interchanged. The objective is to provide an arrangement in which a simplex outlet unit may be plugged into a regular polygonal or round recess (a square recess is exemplified) in a number of orientations so that in each orientation a set of pins 40 (see FIG. 4) on the back of the simplex unit enters a different set of holes 28 in the recess so as to establish connections with buses associated with a different supply or different phases of the same supply. In the example illustrated, the symmetrical arrangment of the holes 28 means that this objective can be achieved for simplex units inserted into recesses 22 on either side of the body 2. Although the configuration shown would appear to permit four different orientations of an outlet in the recess, the outlets 20 are in the examples described configured so as to permit insertion in only three positions, engaging groups of holes 28 linked by the dotted lines labelled a, b and c. The group d of holes in each moulding 4 could be omitted, but their presence provides the mouldings 4 with an additional axis of symmetry which facilitates assembly.

Figure 4:
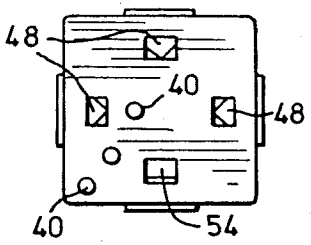
FIGS. 4, 5 and 6 are bottom, side and top views of a simplex outlet unit for insertion into a recess as shown in FIG. 2.
Figure 5:
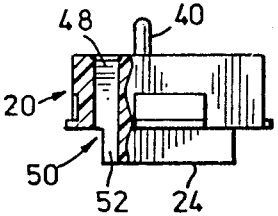
Figure 6:
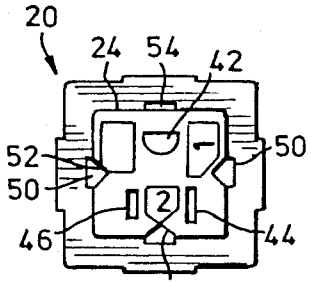

Considering now the simplex outlet units 20, and referring to FIGS. 4–7, each of these is of square plan such as to fit into any of the square recesses 22. On its front face it has a raised square zone 24 defining a receptacle with openings 42, 44, 46 for the pins of a standard three pin appliance plug. The underside of the units is equipped with the pins 40 already mentioned above, which are appropriated connected internally to contacts beneath the openings 42, 44, 46. Also formed in the underside are recesses complementary to the bosses 24 and 26 so as to permit the unit to be received in a recess 22. Three of these recesses 48 are deep enough to accommodate the boss 26 and have windows 50 through the top surface of the unit through which the portion 34 of the boss 26 can protrude into associated notches 52 in three sides of the raised zone 24. No notch is provided in the zone 24 above the fourth recess 54, thus preventing the boss 26 from fully entering the recess. As a result, there are only three permissible orientations of the unit in a recess 22, corresponding to positioning of the pins 40 so as to enter the groups a, b and c of holes 28, but excluding entry to group d. According to which group a, b, c is selected, the boss 26 will enter a different one of the recesses 48, and the extension 34 will enter a different notch 50 to form a visible pointer. As seen in FIG. 6, these notches are labelled "1", "2" and "Data" to identify the different power supplies being tapped.

Referring to FIG. 6, the bosses 24 are undercut on their inner surfaces to form recesses 56. A spring contact blade 58 associated with the opening 42 is formed with a detent 60 on its outer surface which enters a recess 56 as an outlet unit 20 is pressed home in a recess 22, thus holding the unit in place to the extent of the detenting force provided by the blade 58. An inner portion 62 of the blade 58 is configured so that the ground pin 64 of a plug being inserted into the receptacle formed by the unit 20 will force the portion 62 outwards and positively lock the detent 58 in engagement with the recess until such a time as the plug is fully withdrawn. Thus there is no risk of accidentally dislodging the unit by pulling on the plug.

Whilst a double sided unit suitable for incorporation in partition walls has been described, the unit may also be used as a single sided unit, or one of the mouldings 4 may be replaced by a simplified blind moulding. Clearly there is considerable scope for variation in the number and type of power supplies accessed and in the arrangement of the various pins, holes and without departing from the scope of the invention as set forth in the claims. Additionally, other cooperating means on the body and outlet units may be used to indicate to which supply an outlet unit is connected. For example, a single central boss carrying an arrow and projecting from each recess in the body could be used as an indicator, or an indicator behind a window in the outlet unit could be moved to different positions by bosses in the recess according to the position of the outlet. Whilst the invention has been described as applied to units providing standard North American three pin, 120 volt, 15 amp receptacles, the principles of the invention can be applied to other types of outlet provided that a similar outlet can be utilized for each type of supply being serviced.

I claim:

1. An outlet assembly, for providing at least one outlet selectively tapping different groups of conductors present in the assembly and representing different electrical supplies, comprising at least one outlet unit providing a receptacle for receiving a removable plug, and a body having at least one recess , each recess being configured to receive each outlet unit in any one of a plurality of different orientations to which each outlet unit can be rotated about a central axis, the body incorporating a plurality of conductive buses, passing beneath each recess and connected to the conductors of the supplies to be tapped, and defining a pattern of holes located in the bottom of each recess relative to the plurality of buses to enable the latter to be tapped by conductive pins inserted in the holes, each outlet unit having a number of conductive pins on its rear surface at least equal to the number of conductors in a supply to be tapped and connected to outlet sockets in the outlet unit, the pins and holes being arranged so that for different orientations in which each recess can receive each outlet unit, the pins of the latter will tap different groups of conductors representing different supplies, each outlet unit and the body further comprising cooperating means to indicate which supply has been tapped, and cooperating securing means to prevent withdrawal of each outlet unit from the body during removal of a removable plug from that outlet unit.

2. An outlet assembly according to claim 1, wherein the body defines a plurality of said recesses which are identical, for the reception of a plurality of said outlet units which are identical, the body defining an identical pattern of holes in each recess.

3. An outlet assembly according to claim 2, wherein recesses are formed on both sides of a plane including the buses.

4. An outlet assembly according to claim 1, wherein the cooperating means to indicate which supply has been tapped comprises a boss formed in each recess and carrying an indicator means, and indicia formed on an outer surface of each outlet unit so as to be selectively indicated by the indicator means according to the orientation of the unit in the recess.

5. An outlet assembly according to claim 4, wherein each outlet unit has multiple recesses to receive the boss selectively according to the orientation of the unit in the recess, each recess having a window permitting the indicator means to appear through the outlet unit adjacent one of the indicia.

6. An outlet assembly according to claim 1, wherein the cooperating securing means comprise for each outlet unit an interlock means actuable by insertion of a plug in the receptacle to engage the body and lock the unit in the recess.

7. An outlet assembly according to claim 6, wherein the body includes bosses projecting from the base of each recess into openings in an outlet unit engaged therewith so that one of the bosses will be adjacent an opening in the unit for a pin of a plug to be inserted therein regardless of the orientation of the unit in the recess, and wherein the interlock means is a contact blade engaged by a plug pin inserted in the opening such that the blade is held in locking engagement with the adjacent boss.

8. An outlet assembly according to claim 2, wherein each recess is square, and each outlet unit is a square simplex outlet providing a single receptacle, and wherein the conductors represent three different supplies, namely the opposite phases of a three wire supply and an independent supply for equipment sensitive to disturbances, each outlet unit being insertable in each recess in three different orientations in each of which its pins enter a group of holes associated with a different one of the three supplies.

9. An outlet assembly according to claim 8, wherein the holes in each recess are arranged in three concentric squares so that the holes in the outer and middle squares lie on the diagonals of the recess, with the innermost square being rotated through 45° so that the holes thereof tap three different line buses whereas the holes in the other squares tap only two different ground and neutral buses respectively.

* * * * *